US008500233B2

(12) United States Patent
Nagai et al.

(10) Patent No.: US 8,500,233 B2
(45) Date of Patent: Aug. 6, 2013

(54) LIQUID EJECTION HEAD HAVING A LIGHT RECEIVING ELEMENT AND A METHOD OF INSPECTING LIQUID EJECTION HEAD

(75) Inventors: Masataka Nagai, Yokohama (JP); Yoshinori Tagawa, Yokohama (JP); Satoshi Ibe, Yokohama (JP); Kazuhiro Asai, Kawasaki (JP); Hiroyuki Murayama, Kawasaki (JP); Mitsuru Chida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 107 days.

(21) Appl. No.: 13/211,035

(22) Filed: Aug. 16, 2011

(65) Prior Publication Data

US 2012/0044294 A1 Feb. 23, 2012

(30) Foreign Application Priority Data

Aug. 20, 2010 (JP) ..... 2010-185086

(51) Int. Cl.
*B41J 29/393* (2006.01)

(52) U.S. Cl.
USPC ..... 347/19; 347/14; 347/67

(58) Field of Classification Search
USPC ..... 347/14, 19, 20, 44, 47, 56, 61–65, 347/67
See application file for complete search history.

(56) References Cited

U.S. PATENT DOCUMENTS 6,830,309 B2 * 12/2004 Murakami ..... 347/19
6,998,628 B2 * 2/2006 Chelvayohan ..... 347/106

FOREIGN PATENT DOCUMENTS

JP 2002-154202 A 5/2002
JP 2007-098701 A 4/2007

* cited by examiner

*Primary Examiner* — Juanita D Jackson
(74) *Attorney, Agent, or Firm* — Canon USA Inc IP Division

(57) ABSTRACT

A liquid ejection head includes a member having ejection ports and dummy ejection ports. The ejection ports are provided in correspondence with energy-generating elements used in ejecting liquid. The dummy ejection ports are provided in correspondence with a light-receiving element outputting current whose level changes in accordance with the intensity of light applied thereto. By detecting the level of current that is output from the light-receiving element, the shapes of the ejection ports are estimated.

11 Claims, 9 Drawing Sheets

LIQUID EJECTION HEAD HAVING A LIGHT RECEIVING ELEMENT AND A METHOD OF INSPECTING LIQUID EJECTION HEAD

BACKGROUND OF THE INVENTION

1. Field of the Invention

The present invention relates to a liquid ejection head that performs a recording operation by ejecting liquid, a method of inspecting the liquid ejection head, and a liquid ejection apparatus including the liquid ejection head.

2. Description of the Related Art

Liquid ejection heads, such as inkjet recording heads, perform a recording operation by ejecting liquid from ejection ports. The ejection ports are provided in an ejection-port member provided on a liquid-ejection-head substrate having energy-generating elements that generate energy used for ejecting the liquid. The sizes of liquid droplets to be ejected greatly depend on the areas of openings of the ejection ports and therefore vary if the areas of openings vary, leading to unevenness in an image recorded on a recording medium.

Techniques of identifying the areas of openings of ejection ports without actually ejecting liquid droplets are disclosed by Japanese Patent Laid-Open No. 2002-154202 and Japanese Patent Laid-Open No. 2007-098701. A liquid ejection head disclosed by Japanese Patent Laid-Open No. 2002-154202 includes dummy ejection ports in addition to ejection ports used for ejection of liquid. By counting the number of pixels forming an image of each dummy ejection port, the areas of the openings of the ejection ports are estimated.

A liquid ejection head disclosed by Japanese Patent Laid-Open No. 2007-098701 is illustrated in FIG. 10 and includes a member 120. The member 120 has ejection ports 121 and channels 122. The member 120 is provided on a liquid-ejection-head substrate 114 having heat-generating elements 111. An exposure mask used in providing the ejection ports 121 has a plurality of slits of different widths near openings corresponding to the ejection ports 121. When exposure and development are performed on the member 120 with such an exposure mask, the ejection ports 121 and a plurality of slits 123 are provided in the member 120. By measuring the number of slits 123 and the widths of the slits 123, the diameters of the ejection ports 121 are estimated.

According to a review conducted by the present inventors, in the technique disclosed by Japanese Patent Laid-Open No. 2002-154202, an image of the liquid ejection head is read through a microscope, a processing operation of binarizing pixels of the read image is performed, and the pixels are counted. Therefore, it takes time to estimate the diameters of the openings of the ejection ports. Such a technique is not considered to be suitable for mass production.

Meanwhile, the technique disclosed by Japanese Patent Laid-Open No. 2007-098701 employs an indirect measurement method in which the shapes of the openings of the ejection ports are identified from the shapes of slits. In this case, however, factors affecting the shapes of the openings of the ejection ports do not necessarily affect the shapes of the slits in an exactly corresponding way. Therefore, it may be difficult to make accurate evaluation depending on the shapes of the ejection ports.

SUMMARY OF THE INVENTION

In light of the above, the present invention provides a liquid ejection head in which the states of the openings of ejection ports are identified very accurately without ejecting any liquid droplets.

According to an aspect of the present invention, a liquid ejection head includes a liquid-ejection-head substrate having a surface on which energy-generating elements that generate energy to be used in ejecting liquid are provided; a member having an opposing portion and a plurality of through holes extending through the opposing portion, the opposing portion facing the surface of the liquid-ejection-head substrate, wherein some of the through holes functioning as ejection ports are provided in correspondence with the energy-generating elements and through which the liquid is ejected; and a light-receiving element provided on the surface of the liquid-ejection-head substrate to face at least one of the through holes, the light-receiving element outputting a current having a level that changes according to the intensity of light applied thereto.

Further features of the present invention will become apparent from the following description of exemplary embodiments with reference to the attached drawings.

DESCRIPTION OF THE EMBODIMENTS

A liquid ejection head is attachable to apparatuses such as a printer, a copier, a facsimile including a communication system, a word processor including a printer unit, and an industrial recording apparatus to be combined with various processing apparatuses. By using such a liquid ejection head, recording can be performed on various kinds of recording media such as paper, thread, fiber, textile, leather, metal, plastic, glass, wood, and ceramics.

The term "record" used herein refers not only to giving any meaningful images such as characters and diagrams to a recording medium but also to giving any meaningless images such as patterns to a recording medium.

Furthermore, the term "ink" is to be interpreted in a broad sense and refers to liquid that is to be provided on a recording medium and is thus used in forming images and patterns, in processing a recording medium, or in performing a treatment on ink or a recording medium. Exemplary treatments performed on ink or a recording medium include an improvement of fixing capability realized by solidification or insolubilization of the colorant in the ink provided on the recording medium, an improvement of recording quality or color developability, an improvement of image durability, and the like.

Figure 1A:
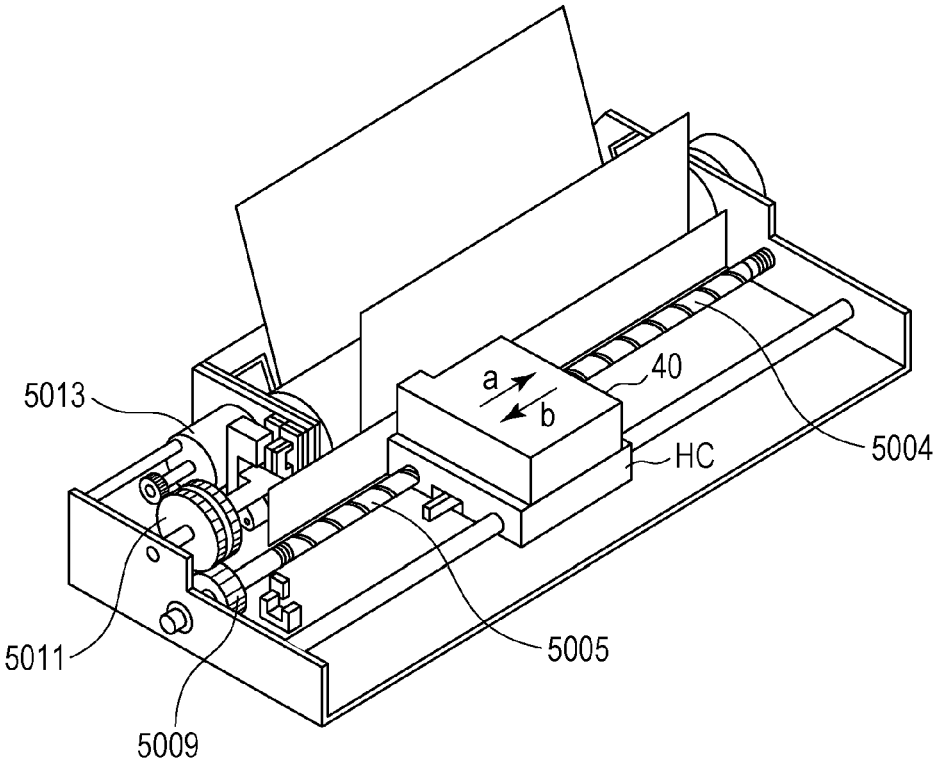
FIG. 1A is a perspective view of a liquid ejection apparatus according to a general embodiment of the present invention.

FIG. 1A is a schematic diagram of a liquid ejection apparatus to which a liquid ejection head according to a general embodiment of the present invention is attachable. As illustrated in FIG. 1A, when a drive motor 5013 rotates in the forward or backward direction, a lead screw 5004 rotates through the intermediary of power transmission gears 5011 and 5009. A carriage HC carries a head unit 40 and has a pin (not illustrated) that engages with a helical groove 5005 provided in the lead screw 5004. When the lead screw 5004 rotates, the carriage HC moves back and forth in the directions of arrows a and b.

Figure 1B:
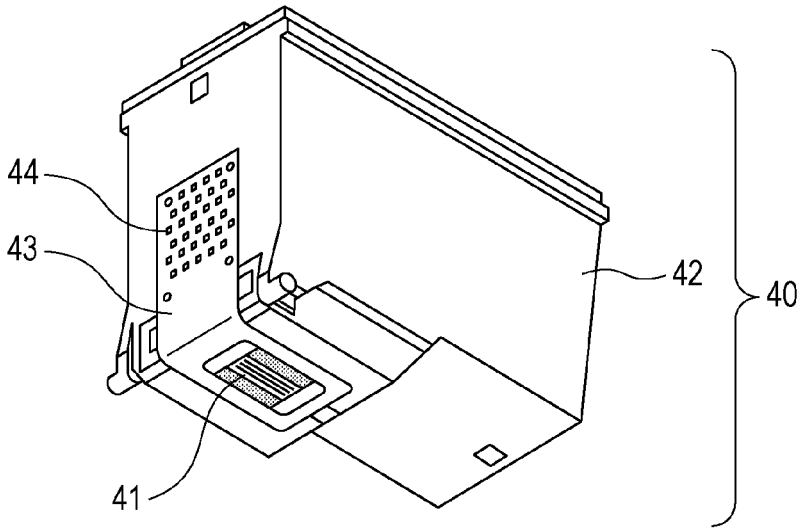
FIG. 1B is a perspective view of a head unit according to the general embodiment of the present invention.

FIG. 1B is a perspective view of the head unit 40 attachable to a liquid ejection apparatus such as the one illustrated in FIG. 1A. A liquid ejection head 41 is electrically continuous with contact pads 44 through the intermediary of a flexible-film printed circuit board 43 connected to electrode terminals 7 (see FIGS. 2A and 2B). The contact pads 44 are to be connected to the liquid ejection apparatus. The liquid ejection head 41 is bonded to an ink tank 42 with a supporting substrate interposed therebetween, whereby the head unit 40 is provided. The head unit 40 exemplified herein is provided as an integral body including the ink tank 42 and the liquid ejection head 41 that are inseparable from each other. Alternatively, a liquid ejection head of a separate type may be employed in which the ink tank is separable from the head.

Figure 2A:
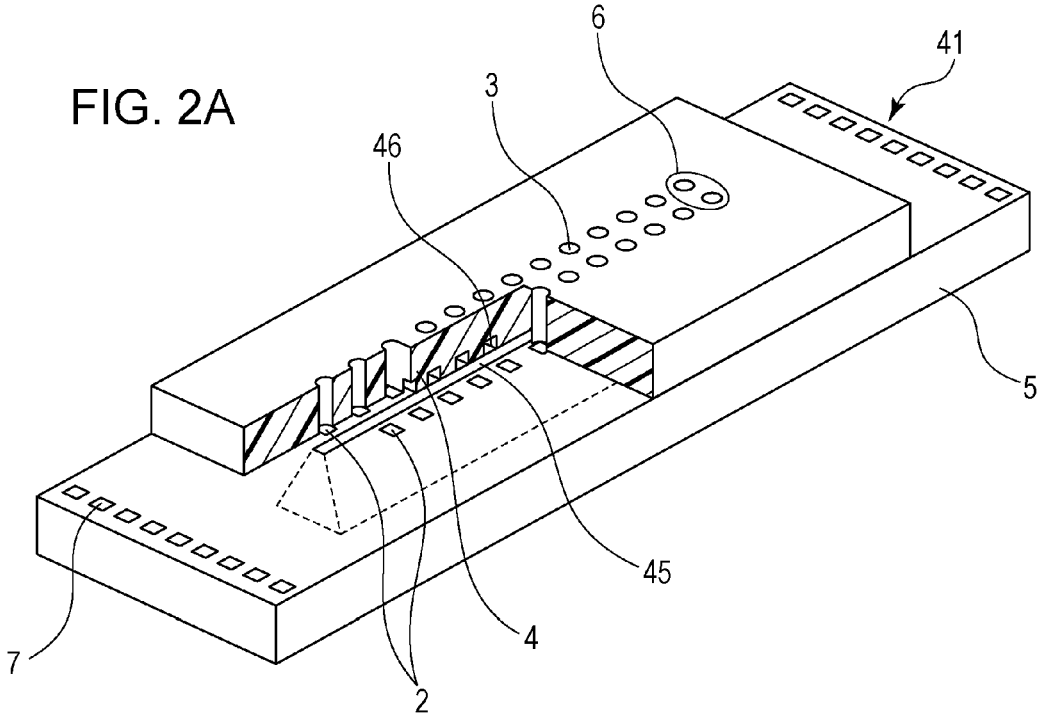
FIG. 2A is a perspective view of a liquid ejection head according to the general embodiment of the present invention.
Figure 2B:
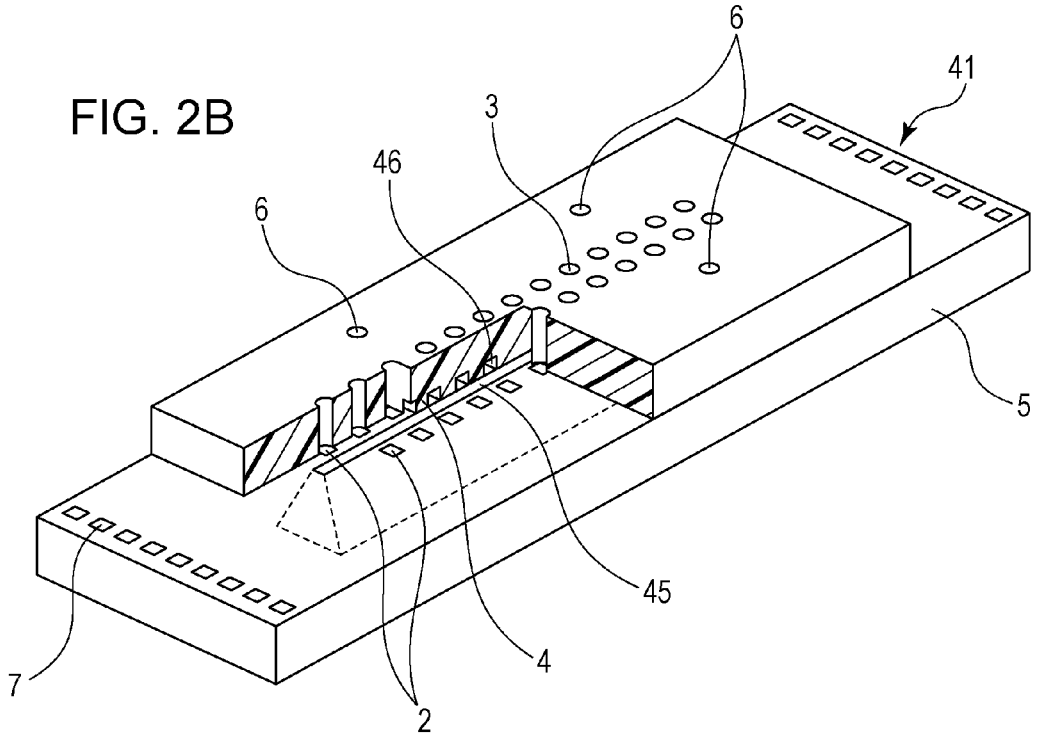
FIG. 2B is a perspective view of another liquid ejection head according to the general embodiment of the present invention.

FIGS. 2A and 2B are each a perspective view of the liquid ejection head 41, which is a feature of the present invention. The liquid ejection head 41 according to the general embodiment of the present invention includes a liquid-ejection-head substrate 5 having energy-generating elements 2 thereon and a channel-wall member 4 provided on the liquid-ejection-head substrate 5. The channel-wall member 4 is a transmissive member made of a light-transmitting resin material. Exemplary transmissive members may include a member made of cured epoxy resin or the like. The channel-wall member 4 has a plurality of through holes extending through an opposing portion thereof that faces a portion of the surface of the liquid-ejection-head substrate 5 having the energy-generating elements 2. The resin material is provided with photosensitivity. The plurality of through holes are obtained (i.e., produced or fabricated) at a time by performing exposure and development on the resin material. The through holes of the channel-wall member 4 are each obtained by making a first opening 36*a* and a second opening 36*b* (see FIG. 3C) communicate with each other, the first opening 36*a* being provided on a side facing the portion of the surface of the liquid-ejection-head substrate 5 having the energy-generating elements 2, the second opening 36*b* being provided on the other side from which liquid is to be ejected.

The plurality of through holes include first through holes used as ejection ports 3 from which liquid is ejected by using energy generated by the energy-generating elements 2. The first through holes are provided in correspondence with the energy-generating elements 2. Specifically, for example, the first through holes are provided in such a manner as to face the respective energy-generating elements 2. The first through holes, i.e., the ejection ports 3, are arrayed at a specific pitch, forming an ejection-port array.

At least one of the remainder of the plurality of through holes can be second through holes used as a dummy ejection port 6 that are not used for recording. By providing the second through holes in substantially the same sizes and shapes as those of the first through holes, the second through holes are used with high reliability.

Referring to FIG. 2A, if the dummy ejection ports 6 are arranged along and continually from the ejection-port array, the dummy ejection ports 6 can be provided in substantially the same states as those of the ejection ports 3. Referring to FIG. 2B, if the dummy ejection ports 6 are provided at a plurality of positions of the liquid ejection head 41 near the ejection-port array, the overall state of the liquid ejection head 41 can be identified. Thus, a more detailed states of almost all of the ejection ports 3 provided in the liquid ejection head 41 can be estimated. Herein, the term "near" refers to at a distance roughly corresponding to the distance between adjacent ones of the ejection ports 3.

The energy-generating elements 2 provided at positions of the liquid-ejection-head substrate 5 facing the ejection port array are arranged in a plurality of rows, thereby forming an element array. Examples of the energy-generating elements 2 include electrothermal transducers, piezoelectric elements, and the like. A supply slit 45 is provided between adjacent rows of the element array. The supply slit 45 extends through the liquid-ejection-head substrate 5, which is made of silicon, thereby allowing liquid to be supplied to the energy-generating elements 2. That is, the supply slit 45 extends from the front surface, having the energy-generating elements 2, to the back surface of the liquid-ejection-head substrate 5.

Although the general embodiment of the present invention concerns a case where the liquid ejection head 41 has one supply slit 45, the present invention is also applicable to a liquid ejection head having a plurality of supply slits 45. The channel-wall member 4 has depressions that are to become channels 46 communicating with the ejection ports 3 and the dummy ejection ports 6. The channels 46 are obtained by bringing the channel-wall member 4 and the liquid-ejection-head substrate 5 into contact with each other.

Figure 3A:
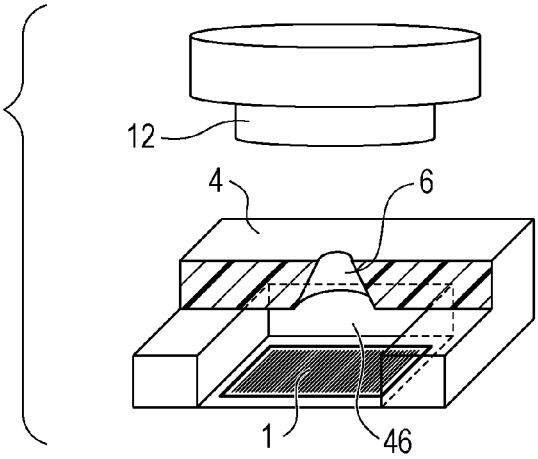
FIG. 3A is a transparent perspective view illustrating a part of the liquid ejection head according to the general embodiment of the present invention.

Referring to FIG. 3A, a light-receiving element 1 can be provided at each of the positions of the liquid-ejection-head substrate 5 facing the respective through holes that are used as the dummy ejection ports 6. Optionally, one light-receiving element may be used for a plurality of the dummy ports 6. The light-receiving element 1 is made of a semiconductor material and is used for evaluation of the shapes of the ejection ports 3. The light-receiving element 1 outputs different levels of current in accordance with the intensity of light received. Examples of the light-receiving element 1 include a group of wires 9 whose resistances change when light is applied thereto, and a semiconductor device such as a complementary-metal-oxide-semiconductor (CMOS) device or a charge-coupled device (CCD) that outputs, as electric current, electric charge stored therein by an amount corresponding to the intensity of light.

FIG. 3A is a transparent perspective view of an exemplary dummy ejection port 6 provided in the liquid ejection head 41. When light from a light source 12 is applied to a side of the channel-wall member 4 opposite the side that is in contact with the liquid-ejection-head substrate 5, i.e., the side having the dummy ejection port 6, the light is transmitted through the channel-wall member 4 and falls onto the light-receiving element 1.

The light-receiving element 1 is capable of detecting the difference in the intensity of light. The intensity of light changes with changes in the area of the first opening 36*a* (first opening area), the area of the second opening 36*b* (second opening area), and the thickness of the channel-wall member 4 at the dummy ejection port 6 (denoted by Z1 in FIG. 3C and hereinafter also referred to as ejection-port thickness). The difference in the intensity of light is converted into a shape, whereby the states of the first and second openings 36*a* and 36*b* of the dummy ejection port 6 and a tapered portion therebetween are identified. Thus, the three-dimensional shapes of the through holes provided in the channel-wall member 4 are estimated. In the manufacturing process, the through holes including the dummy ejection ports 6 and the ejection ports 3 are provided at a time, so that the through holes have substantially the same shape with less variation. Therefore, it is possible to estimate the shapes of the ejection ports 3 from the shapes of the dummy ejection ports 6. Hence, if the liquid ejection head 41 is ranked on the basis of the three-dimensional shapes of the dummy ejection ports 6 and the result is recorded on an information-storing medium (not illustrated) included in the head unit 40, the liquid ejection apparatus can be controlled on the basis of the recorded rank. Thus, even if there are any differences between individual liquid ejection heads 41, the quality of recorded matter is maintained to be at a certain level.

Alternatively, if the liquid ejection head 41 including the light-receiving elements 1 is attached to a liquid ejection apparatus together with a unit configured to emit light, the rank of the liquid ejection head 41 can be identified after the liquid ejection head 41 is attached to the liquid ejection apparatus.

Specific exemplary embodiments of the liquid ejection head 41 including the light-receiving elements 1 will now be described.

First Exemplary Embodiment

A first exemplary embodiment concerns a case where the light-receiving elements 1 are each a film 14 made of a semiconductor material whose resistance changes in accordance with the intensity of light received. The film 14 is provided in the form of a plurality of linear wires arranged at regular intervals over a specific area. Exemplary materials of the film 14 include a material whose resistance is reduced by receiving light. Specifically, the material may be any of the following: compound semiconductors such as cadmium sulfide, zinc oxide, gallium arsenide, indium phosphide, and gallium nitride; and amorphous and polycrystalline semiconductors such as silicon and germanium. The film 14 is formed by vapor deposition, sputtering, or chemical vapor deposition (CVD) in such a manner as to have a thickness of about 100 nm, and is subsequently processed into wires 9 by photolithography or dry etching. The wires 9 are covered with an optional protective layer 17 made of, for example, boron-doped phospho-silicate glass (BPSG) that transmits light and is resistant to liquid.

Figure 3B:
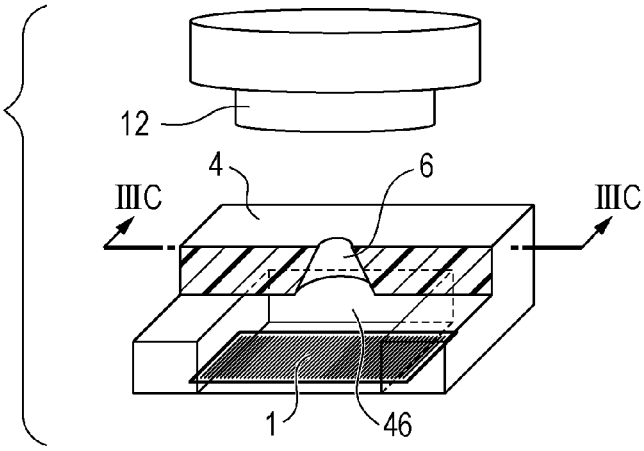
FIG. 3B is a transparent perspective view illustrating a part of a liquid ejection head according to a first exemplary embodiment of the present invention.
Figure 3C:
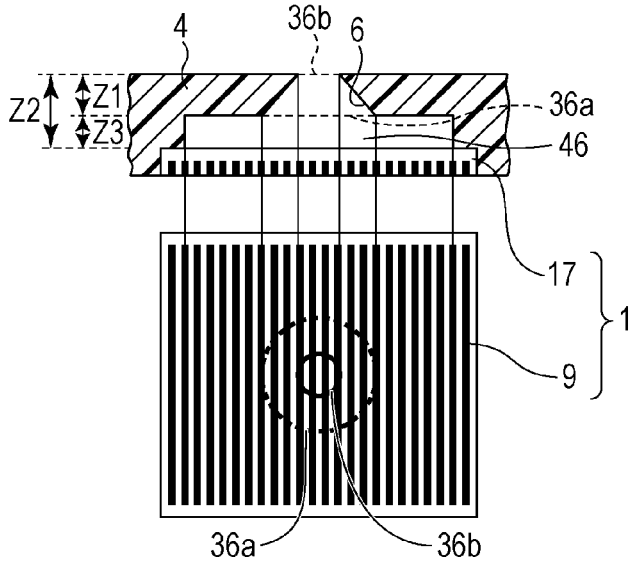
FIG. 3C is a sectional view illustrating the part of the liquid ejection head according to the first exemplary embodiment of the present invention.

FIG. 3B is a transparent perspective view of an exemplary dummy ejection port 6. FIG. 3C schematically illustrates a section of the liquid ejection head 41 taken along line IIIC-IIIC illustrated in FIG. 3B, the section being perpendicular to the top surface of the liquid-ejection-head substrate 5.

The light-receiving element 1 resides below the channel-wall member 4 when the liquid-ejection-head substrate 5 is seen from a side on which the dummy ejection port 6 is provided. The size of the dummy ejection port 6 may vary because of manufacturing errors. Therefore, the light-receiving element 1 is provided over an area including, or covering, an area defined by a projection of the dummy ejection port 6. The area over which the light-receiving element 1 extends is larger than the area defined by the projection of the dummy ejection port 6. Moreover, as illustrated in FIG. 3B, the light-receiving element 1 may extend over portions of the liquid-ejection-head substrate 5 that are in contact with the channel-wall member 4. Thus, it is possible to identify the thickness of the channel-wall member 4 at a portion thereof overlying the light-receiving element 1 (denoted by Z2 and hereinafter also referred to as channel-wall thickness) and the distance between the light-receiving element 1 and the first opening 36*a* (denoted by Z3 and hereinafter also referred to as height to ejection port).

The channel-wall member 4 is made of a material that transmits light from the light source 12. Specifically, the channel-wall member 4 is obtained by curing thermosetting resin such as epoxy resin. The optical absorbance (transmittance) of such resin changes in accordance with the wavelength of light. Furthermore, the amount of light to be absorbed by the resin changes with an increase in the thickness of the resin. Therefore, the intensity of light reaching the light-receiving element 1 varies between a portion below the dummy ejection port 6 and a portion below the channel-wall member 4. The light-receiving element 1, made of a semiconductor material, produces a photoconductive effect under light at wavelengths of 700 nm and shorter. By utilizing the photoconductive effect, the difference in the intensity of light received is detected. Thus, the shape of the dummy ejection port 6 in the X or Y direction is determined. Furthermore, if the relationship between the intensity of light received and the thickness of the channel-wall member 4 is known, the thickness of the channel-wall member 4 can be identified from the value detected by the light-receiving element 1.

Figure 4:
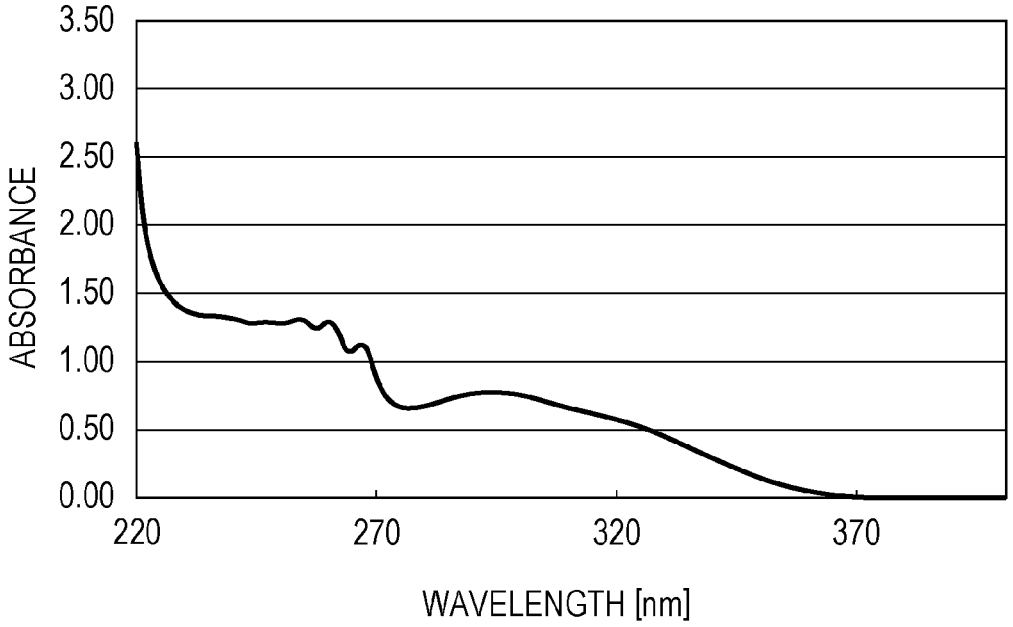
FIG. 4 illustrates the results of an exemplary measurement of the absorbance of a channel-wall member.

FIG. 4 illustrates exemplary data of measured absorbance of a cured epoxy resin member, i.e., the channel-wall member 4, having a thickness of about 11 μm. The data shows that the channel-wall member 4 absorbs light at wavelengths of about 360 nm and shorter. Therefore, the light from the light source 12 is to be at a wavelength of about 360 nm or shorter.

Specifically, if the light source 12 emits light at a wavelength between about 220 nm to about 360 nm, the thickness of the channel-wall member 4 on the perimeter of the dummy ejection port 6 is set to such a value that realizes a transmittance of 5% or higher and 95% or lower. In addition, the relationship between the intensity of light received by the light-receiving element 1 and the resistance of the light-receiving element 1 shows that the resistivity of the light-receiving element 1 increases fivefold at maximum when the intensity of light received is reduced to one tenth. Therefore, if the thickness of the channel-wall member 4 is set to such a value that realizes a transmittance of 10% or higher and 90% or lower, a highly reliable inspection can be performed.

Now, a method of inspecting the liquid ejection head 41 will be described.

When light is applied from the light source 12 toward the dummy ejection port 6 from a side of the channel-wall member 4 that is not in contact with the liquid-ejection-head substrate 5, i.e., from above the second opening 36*b*, the light is transmitted through the channel-wall member 4 and falls onto the wires 9, which are provided as a semiconductor film forming the light-receiving element 1. Herein, it is supposed that the wires 9 are made of cadmium sulfide. The resistance of cadmium sulfide becomes smaller as the amount of light received increases. That is, the resistances of the respective wires 9 of the light-receiving element 1 change in accordance with the amount of light received, i.e., with changes in the areas of the first and second openings 36*a* and 36*b* of the dummy ejection port 6, in the shape of the tapered portion, and in the channel-wall thickness.

By calculating the areas of the first and second openings 36*a* and 36*b* of the dummy ejection port 6, the channel-wall thickness, and the height to ejection port from such changes in the resistances of the wires 9, the three-dimensional shape of the dummy ejection port 6 can be identified without ejecting liquid. Furthermore, the rank of the liquid ejection head 41 can be determined on the basis of the three-dimensional shape. Consequently, a highly reliable recording operation can be performed.

Figure 5:
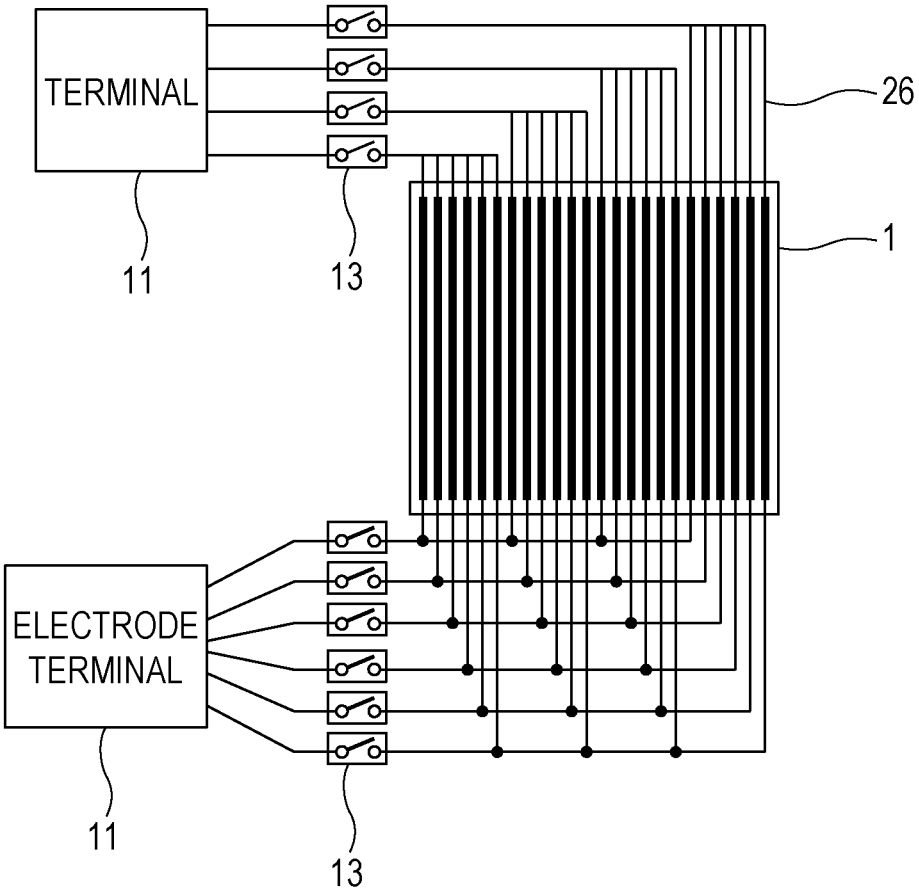
FIG. 5 is a circuit diagram of a light-receiving element according to the first exemplary embodiment of the present invention.

As schematically illustrated in FIG. 5, the light-receiving element 1 is connected to electrode terminals 11 for resistance measurement with wiring layers 26 made of aluminum (Al) or the like and switching elements 13 for resistance measurement interposed therebetween. The resistance across the electrode terminals 11 is measured by sequentially switching among circuits with the switching elements 13. In a region where the resistance is constant, the channel-wall thickness is considered to be uniform. In a region where a sharp change in the resistance is observed, it is considered that there is a change in the channel-wall thickness because of the presence of the dummy ejection port 6 or the like.

The measurement is performed for each of the wires 9. Therefore, the wire pitch (repetition width) corresponds to the accuracy in detecting the shape of the dummy ejection port 6. The finer the wire pitch is set, the more accurately the detection can be performed. If the first and second openings 36*a* and 36*b* of the dummy ejection port 6 are provided with diameters of about 20 μm and about 10 μm, respectively, the width of each side of the tapered portion in sectional view is about 5 μm. Therefore, the wire pitch is preferably set to about 2 μm or smaller so that measurement can be performed at two or more positions on each side of the tapered portion. In addition, to maintain the accuracy in patterning the wires 9, the wire pitch is preferably about 0.05 μm or larger.

Furthermore, to make the resistances of the respective wires 9 uniform, the lengths of all wires 9 are made uniform. For values of the ejection-port thickness (Z1) that are equal to each other, the resistances detected by corresponding ones of the wires 9 are the same. In a region where the dummy ejection port 6 is present and there is a change in the three-dimensional shape thereof, the amount of light received changes and the resistance changes correspondingly. Hence, by reading the difference in the resistance, the three-dimensional shape of the dummy ejection port 6 can be detected. If the light-receiving element 1 is provided in such a manner as to extend over portions immediately below the channel-wall member 4 as illustrated in FIG. 3B, the channel-wall thickness (Z2) can also be identified.

Figure 6A:
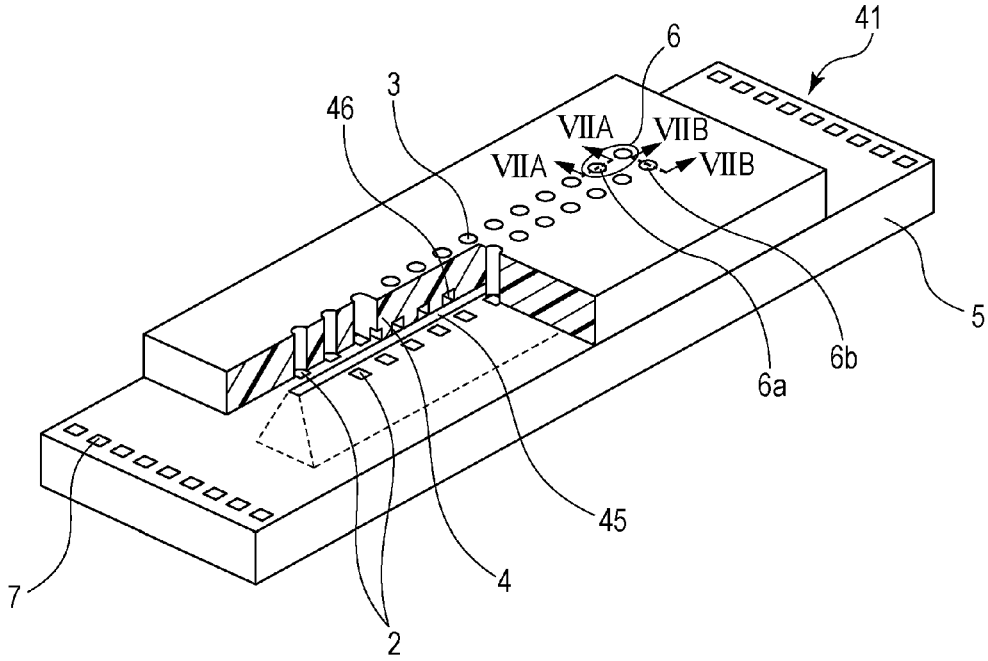
FIG. 6A is a perspective view of the liquid ejection head according to the first exemplary embodiment of the present invention.
Figure 6B:
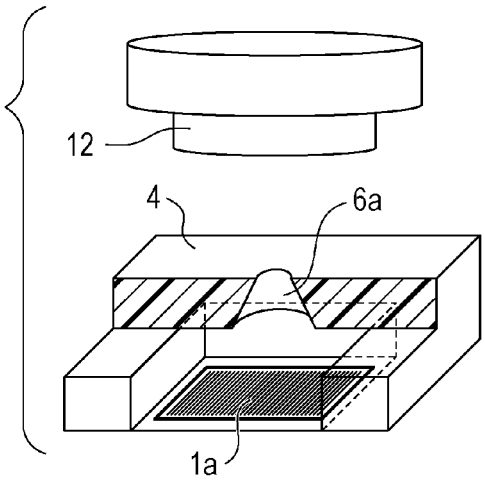
FIG. 6B is a transparent perspective view illustrating a part of the liquid ejection head according to the first exemplary embodiment of the present invention.
Figure 6C:
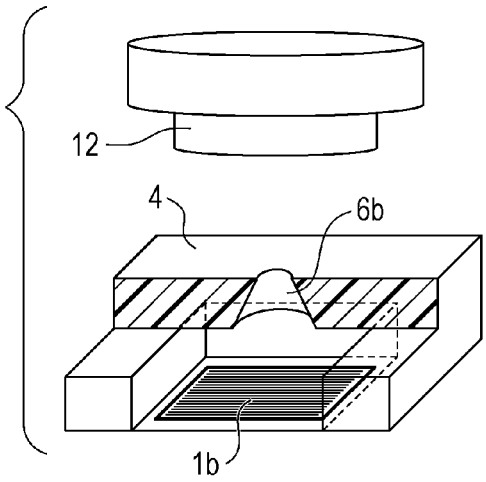
FIG. 6C is a transparent perspective view illustrating another part of the liquid ejection head according to the first exemplary embodiment of the present invention.

As illustrated in FIG. 6A, a first dummy ejection port 6*a* having a first light-receiving element 1*a* (see FIG. 6B) and a second dummy ejection port 6*b* having a second light-receiving element 1*b* (see FIG. 6C) may be provided adjacent to each other. The wires 9 of the second light-receiving element 1*b* extend orthogonal to the wires 9 of the first light-receiving element 1*a*. If two light-receiving elements 1 whose wires extend in two respective directions that are orthogonal to each other are provided adjacent to each other and the three-dimensional shapes of the ejection ports 3 are thus estimated from two groups of resistances, even the areas of ejection ports 3 not having perfect circular shapes but having oval shapes or the like can be estimated accurately.

Figure 7A:
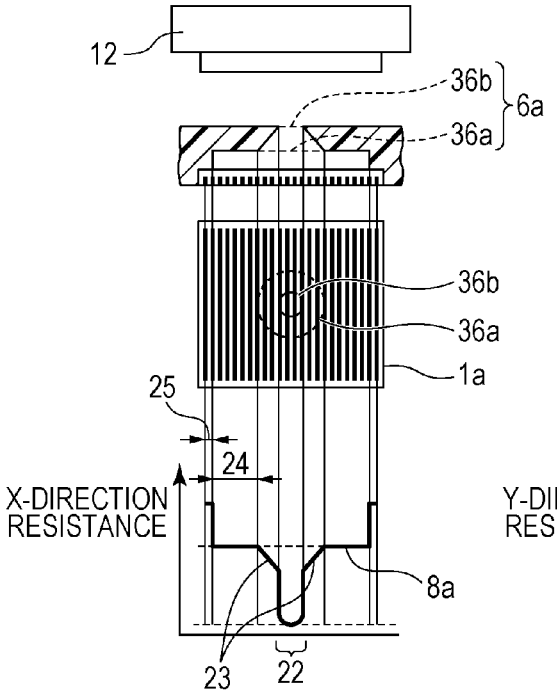
FIG. 7A includes a sectional view of the part of the liquid ejection head illustrated in FIG. 6B and a plot of a measured current profile.
Figure 7B:
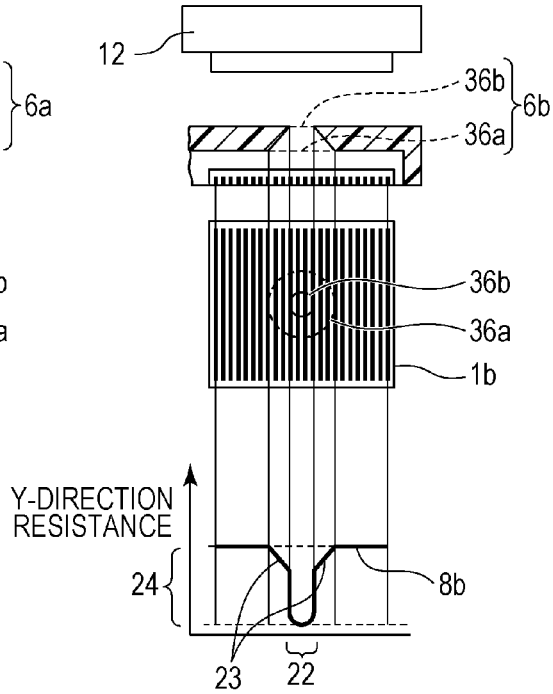
FIG. 7B includes a sectional view of the part of the liquid ejection head illustrated in FIG. 6C and a plot of a measured current profile.

FIGS. 7A and 7B illustrate how the resistance changes under the light from the light source 12. FIG. 7A includes a sectional view of the first dummy ejection port 6*a* illustrated in FIG. 6A taken vertically to the surface of the liquid ejection head 41 along line VIIA-VIIA and a plot of a resistance profile 8*a* representing the resistances of the wires 9. FIG. 7B includes a sectional view of the second dummy ejection port 6*b* illustrated in FIG. 6A taken vertically to the surface of the liquid ejection head 41 along line VIIB-VIIB and a plot of a resistance profile 8*b* representing the resistances of the wires 9. Since the channel-wall member 4 is not present in the second opening 36*b*, the light from the light source 12 reaches each light-receiving element 1 without being absorbed. Therefore, the resistance profile 8 is the lowest in an area 22. Areas 23 correspond to the two respective sides of the tapered portion defined between the first opening 36*a* and the second opening 36*b*, the areas 23 each ranging from the edge of a corresponding one of areas 24 to the edge of the area 22. The areas 24 correspond to the top surface of the channel. The resistances in the respective areas 23 gradually change in the same manner. Areas 25 of the resistance profile 8*a* correspond to a part where the light-receiving element 1*a* and the channel-wall member 4 are in contact with each other. The resistance profile 8*a* becomes the highest in the areas 25 because the thickness of the channel-wall member 4 is the largest.

Figure 7C:
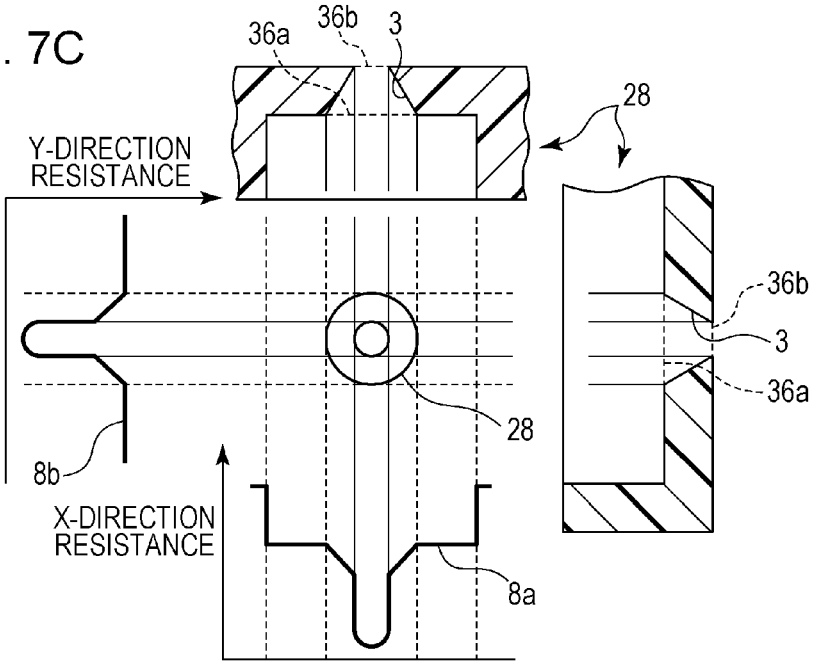
FIG. 7C illustrates an estimated three-dimensional shape of a part of the liquid ejection head according to the first exemplary embodiment of the present invention.

On the basis of such changes in the resistance profile 8*a* and the resistance profile 8*b*, it is possible to estimate a three-dimensional shape 28 of each ejection port 3, as illustrated in FIG. 7C, determined by the areas of the first and second openings 36*a* and 36*b*, the ejection-port thickness, the channel-wall thickness, the height to ejection port, and so forth. The liquid ejection head 41 can be ranked on the basis of the three-dimensional shape 28.

If the state of the liquid ejection head 41 identified on the basis of the result of the above inspection is written on, for example, an information-storing medium (not illustrated) of the liquid ejection apparatus and an ejection operation is controlled in accordance with the identified state of the liquid ejection head 41, the quality of recorded matter can be maintained to be at a certain level even if there are any variations between different liquid ejection heads 41.

A plurality of liquid ejection heads 41 are manufactured at a time through a semiconductor process in which a plurality of liquid ejection heads 41 are formed on one wafer and the wafer is then cut into individual pieces of the liquid ejection heads 41. Since the channel-wall members 4 of such liquid ejection heads 41 are thicker than the light-receiving elements 1, the thicknesses of the channel-wall members 4 formed on one wafer tend to vary in the manufacturing process. Accordingly, the sizes of the ejection ports 3 (dummy ejection ports 6) tend to vary between different liquid ejection heads 41.

Therefore, if the three-dimensional shapes of the dummy ejection ports 6 are identified by using light-receiving elements 1 whose thicknesses tend to vary little, the volume of each space defined as the ejection port 3, i.e., the amount of liquid to be ejected, can be estimated accurately. Thus, a highly reliable liquid ejection head is provided in which, when attached to a liquid ejection apparatus, a control operation for preventing the occurrence of unevenness in the color of recorded matter can be performed without actually ejecting liquid.

Figure 9:
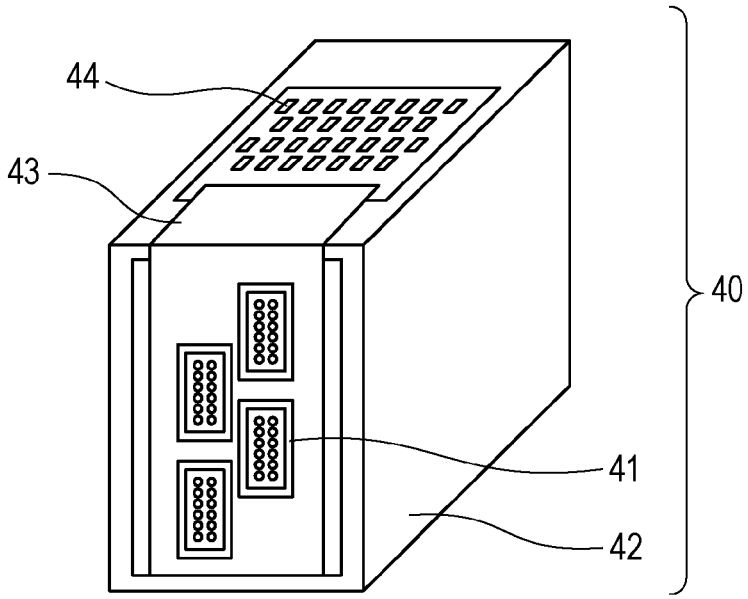
FIG. 9 is a perspective view of a head unit according to the first exemplary embodiment of the present invention.
Figure 10:
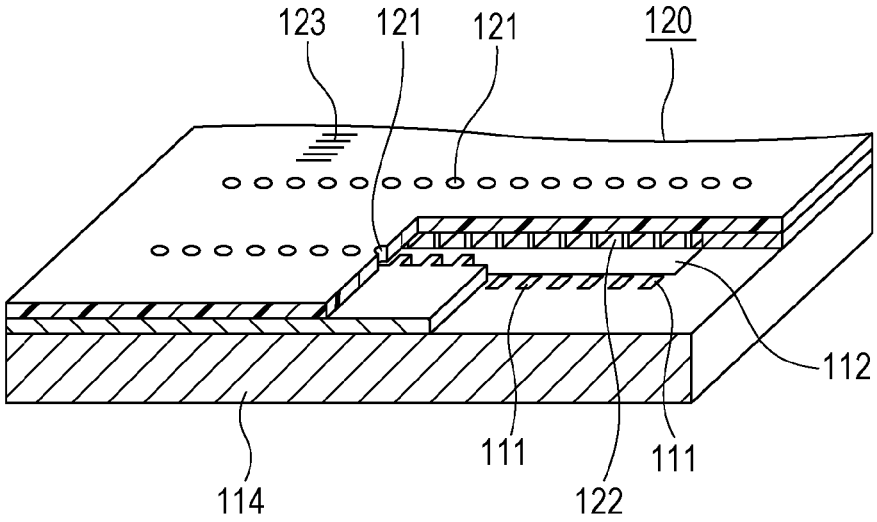
FIG. 10 is a partially cutaway perspective view of a liquid ejection head according to a related-art technique.

In a case where a plurality of liquid ejection heads 41 are included in one head unit 40 as illustrated in FIG. 9, the quality of recorded matter can be improved by preparing the liquid ejection heads 41 of the same rank and controlling the individual liquid ejection heads 41 such that the amounts of ejection therefrom become uniform.

Second Exemplary Embodiment

A second exemplary embodiment of the present invention will now be described in which a semiconductor device such as a charge-coupled device (CCD) is employed as the light-receiving element 1. The other configurations are the same as those in the first exemplary embodiment.

Figure 8A:
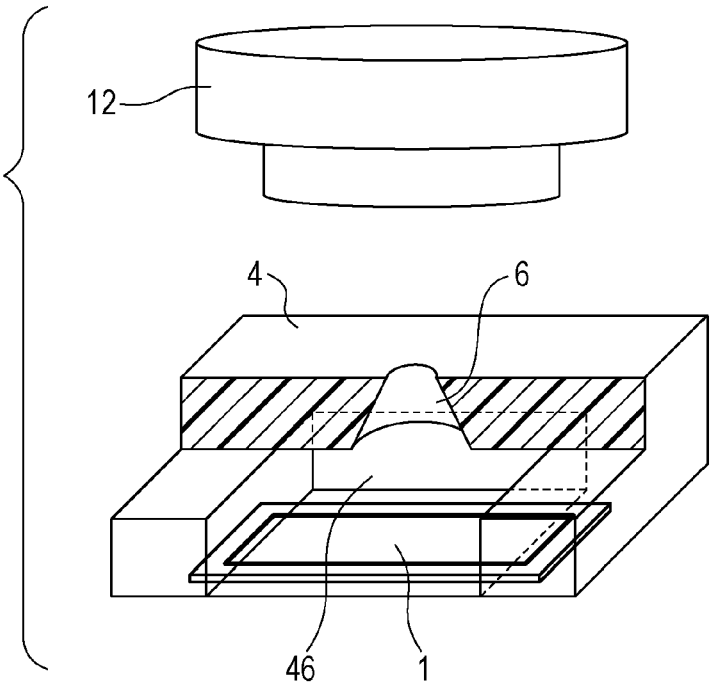
FIG. 8A is a transparent perspective view illustrating a part of a liquid ejection head according to a second exemplary embodiment of the present invention.
Figure 8B:
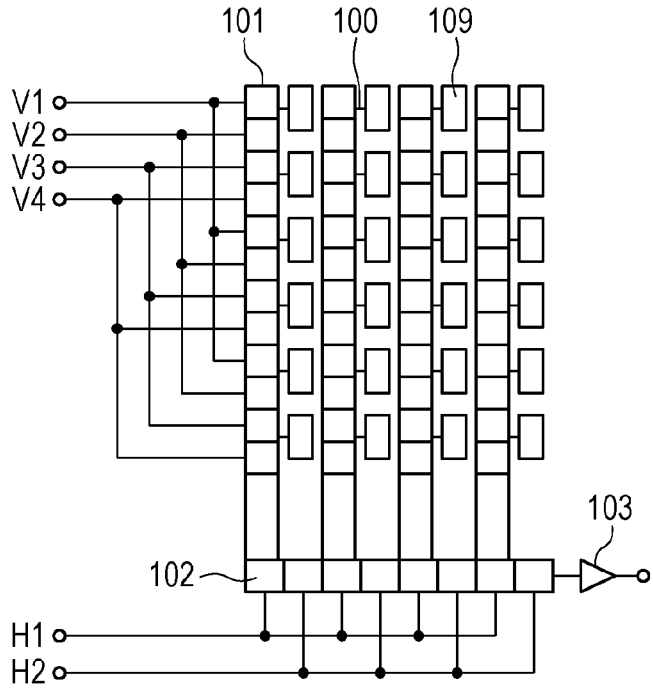
FIG. 8B is a schematic diagram of a charge-coupled device (CCD) according to the second exemplary embodiment of the present invention.

Referring to FIG. 8A, in the case where a CCD is employed as the light-receiving element 1, the smallest unit of measurement corresponds to one pixel of the CCD. Therefore, the size of each pixel is directly translated as the accuracy in detecting the shape of the dummy ejection port 6. With the CCD, the profiles in two respective directions of the X and Y directions can be estimated simultaneously. FIG. 8B is a schematic diagram of a so-called interline CCD. Referring to FIG. 8B, the operation of the CCD will be described briefly. A plurality of photodiodes 109 forming a light-receiving element 1 are connected to vertical-transfer CCD components 101, which transfer charges, via respective transfer gates 100. The photodiodes 109 and the vertical-transfer CCD components 101 are arranged alternately in the form of vertical rows. The ends of the vertical-transfer CCD components 101 are connected to a horizontal-transfer CCD component 102. When the photodiodes 109 receive light, the photodiodes 109 produce charges. When the transfer gates 100 are opened, the charges are transferred to the vertical-transfer CCD components 101. The charges transferred to the vertical-transfer CCD components 101 are further transferred to the horizontal-transfer CCD component 102 and subsequently to a correlated-double-sampling (CDS) portion 103.

The amount of charge to be transferred, i.e., the level of current to be output, changes in accordance with the intensity of light received by each photodiode 109. That is, the level of current to be output changes in accordance with the thickness of the channel-wall member 4 at the dummy ejection port 6. By estimating the areas of the openings 36*a* and 36*b* of the dummy ejection port 6, the channel-wall thickness, and the height to ejection port from such changes in the level of current, the three-dimensional shape of the dummy ejection port 6, i.e., the volume of a droplet to be ejected, can be identified. Thus, the rank of the liquid ejection head 41 can be determined without ejecting any droplets. Through such a series of operations, the three-dimensional shape of the dummy ejection port 6 is identified on the basis of the intensities of light in different regions.

Instead of the CCD, a complementary-metal-oxide-semiconductor (CMOS) device may be similarly employed for identifying the three-dimensional shape of the dummy ejection port 6.

As described above, by providing light-receiving elements that output different levels of current in accordance with the intensity of light applied thereto at positions facing the respective second through holes, there is provided a highly reliable liquid ejection head in which the shapes of the ejection ports thereof can be estimated more accurately without ejecting liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-185086 filed Aug. 20, 2010, which is hereby incorporated by reference herein in its entirety.

What is claimed is:

1. A liquid ejection head comprising:

a liquid-ejection-head substrate having a surface on which energy-generating elements that generate energy to be used in ejecting liquid are provided;

a member having an opposing portion and a plurality of through holes extending through the opposing portion, the opposing portion facing the surface of the liquid-ejection-head substrate, wherein some of the through holes functioning as ejection ports are provided in correspondence with the energy-generating elements and through which the liquid is ejected; and a light-receiving element provided on the surface of the liquid-ejection-head substrate to face at least one of the through holes, the light-receiving element outputting a current having a level that changes according to the intensity of light applied thereto, wherein the light-receiving element extends over an area including areas of the surface of the liquid-ejection-head substrate defined by projections of the through holes.

2. The liquid ejection head according to claim 1, wherein the member is made of cured epoxy resin.

3. The liquid ejection head according to claim 1, wherein the plurality of through holes are produced by making a first opening and a second opening communicate with each other, the first opening being provided in a first surface of the member that faces the surface of the liquid-ejection-head substrate, the second opening being provided in a second surface of the member opposite the first surface.

4. The liquid ejection head according to claim 1, wherein the plurality of through holes are produced at a time by performing exposure and development on a photosensitive resin material.

5. The liquid ejection head according to claim 1, wherein the member has a transmittance of 5% to 95% on a perimeter of each of the through holes exposed to light having a wavelength ranging from 220 nm to 360 nm.

6. The liquid ejection head according to claim 1, wherein the light-receiving element includes a plurality of wires made of a material whose resistance changes when light is applied thereto.

7. The liquid ejection head according to claim 6, wherein the material is any of a compound semiconductor, an amorphous semiconductor, and a polycrystalline semiconductor.

8. The liquid ejection head according to claim 1, wherein the light-receiving element comprises a semiconductor device that stores charge by receiving light.

9. The liquid ejection head according to claim 8, wherein the light-receiving element comprises a charge-coupled device or a complementary-metal-oxide-semiconductor device.

10. A liquid ejection apparatus to which the liquid ejection head according to claim 1 is attachable, the apparatus comprising a unit configured to apply light to the liquid ejection head from above the member.

11. A method of inspecting the liquid ejection head according to claim 1, comprising:

applying light to the light-receiving element through the through hole; and measuring the level of current that is output from the light-receiving element.

* * * * *